United States Patent [19]

Reinke et al.

[11] 4,291,207

[45] Sep. 22, 1981

[54] REMOVABLE PUSH-TO-UNLOCK ACTUATOR FOR LOCKING PIVOTED-SUBACTUATOR SELF-ENCLOSED ELECTRIC SWITCH

[75] Inventors: William L. Reinke, Cedarburg, Wis.; John W. Stearley, Smithfield, N.C.

[73] Assignee: Eaton Corporation, Cleveland, Ohio

[21] Appl. No.: 111,149

[22] Filed: Jan. 11, 1980

[51] Int. Cl.[3] ..... H01H 27/00

[52] U.S. Cl. ..... 200/42 R; 200/325; 200/332; 200/335; 200/339

[58] Field of Search ..... 200/42 R, 325, 329, 200/335, 332, 339, 153 H, 153 G, 44

[56] References Cited

U.S. PATENT DOCUMENTS

| | | | |
|---|---|---|---|
| 3,205,320 | 9/1965 | Soscia | 200/44 |
| 3,435,169 | 3/1969 | Bienwald et al. | 200/339 |
| 3,497,646 | 2/1970 | Pollak | 200/42 R |
| 3,681,556 | 8/1972 | Qsika | 200/339 |
| 3,761,664 | 9/1973 | Kodaira | 200/339 |

*Primary Examiner*—Willis Little

*Attorney, Agent, or Firm*—R. J. McCloskey; H. Rather; W. A. Autio

[57] ABSTRACT

A unitary, self-enclosed electric switch having a pivotally mounted subactuator (6) that actuates the contacts (18 ) and carries a locking element (24) that normally catches on the switch housing (**4*k*) to lock the switch in "off" position. A combined actuator and lock release member (8) is snap-in mounted on the subactuator and has push-to-unlock means (8*b*, 8*c*, 22) that releases the off-lock to allow pivotal actuation of this actuator and the subactuator in unison from "off" to "on" position. This actuator is normally spring-biased (22) into ineffective position from which it must be pushed in to unlock the switch and is removable to prevent unauthorized use of the switch. The subactuator has an upward extension (6*h*) that serves as a handle to enable the switch to be moved from "on" to "off" position even when the actuator has been removed, this extension serving also to trap the actuator bias spring (22**) to retain it in place when the actuator is removed. The off-lock shown could be changed to an on-lock by rearranging the contacts or reversing the locking element.

4 Claims, 5 Drawing Figures

REMOVABLE PUSH-TO-UNLOCK ACTUATOR FOR LOCKING PIVOTED-SUBACTUATOR SELF-ENCLOSED ELECTRIC SWITCH

BACKGROUND OF THE INVENTION

Manual keys, thumb-buttons, and the like for releasing locking-type switch operators of various types have been known heretofore. However, these prior structures have not provided the combination of features desired for greater safety in maintained-type electric tool switches such as automatic locking in the "off" position only, removability of the combined actuator and lock-release member to prevent unauthorized movement of the subactuator from "off" to "on" position while affording easy actuation thereof from "on" to "off" position even when the combined actuator and lock-release member has been removed, retention of the combined actuator and lock-release member on the subactuator with the switch locked, requiring a push-to-unlock motion to allow operation of the switch, trapping of the bias spring on the subactuator to allow removal of the combined actuator and lock-release member, and meeting of the "palm test", that is, preventing the switch from being turned on if struck by the palm of the hand although the combined actuator and lock-release member is inserted in place on the subactuator. Consequently, it has been found desirable to provide an improved mechanism incorporating all of these safety features in one unit.

SUMMARY OF THE INVENTION

An object of the invention is to provide an improved safety switch of the pivoted-actuator type.

A more specific object of the invention is to provide an improved safety switch of the aforementioned type having a combination of safety features including automatic locking in the "off" position only, while the combined actuator and push-to-unlock member is in place, removability of the push-to-unlock member to prevent unauthorized operation from "off" to "on" while affording easy actuation from "on" to "off" even when the push-to-unlock member has been removed, retention of the push-to-unlock member on the switch with the switch locked, requiring a push-to-unlock motion against a bias spring to allow operation of the switch and to prevent accidental operation, trapping the bias spring in the subactuator to allow removal of the push-to-unlock member, and meeting of the "palm test" whereby striking the switch with the palm of the hand or other accidental bump will not cause the switch to close although the push-to-unlock member is in place thereon.

Another specific object of the invention is to provide an improved on-locking switch.

Other objects and advantages of the invention will hereinafter appear.

DESCRIPTION OF THE PREFERRED EMBODIMENT

Referring to FIGS. 1–5, there is shown an off-locking; pivoted-actuator, maintained electric switch incorporating a removable push-to-unlock actuator. "Maintained" refers to a switch of the type that when actuated "on" remains "on" as distinguished from a "momentary" switch which when actuated "on" automatically returns "off"when the actuator is released.

As shown therein, the switch is provided with a housing comprising a molded insulating base 2 and a frame 4. This base is a generally rectangular cup-shaped member having an open top, in the orientation illustrated, that is closed by the frame and an actuator assembly, the latter being pivotally supported in the frame as hereinafter described. This base is arranged to accommodate double-pole single-throw switch contacts; however, one pole, or set of contacts, is shown for illustrative purposes in FIGS. 1 and 4, since the other set of contacts, or pole, is similar.

As shown in FIGS. 2–5, the actuator assembly comprises a subactuator 6 pivotally mounted on the frame and a snap-in, removable, push-to-unlock lock-releasing actuator 8, or combined actuator and lock-release member, hereinafter more fully described.

Figure 1:
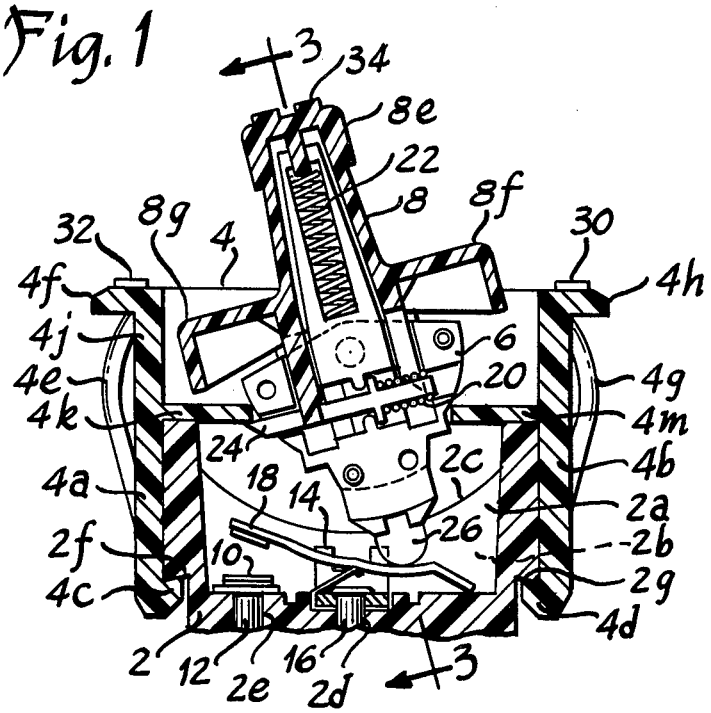
FIG. 1 is an enlarged off-center cross-sectional view of the switch showing the off-locking and push-to-unlock mechanism thereof.
Figure 4:
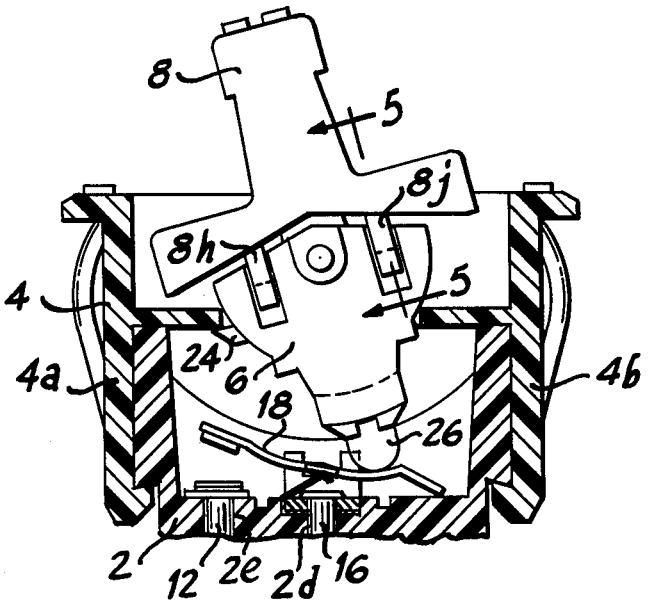
FIG. 4 is an enlarged cross-sectional view through one side of the switch housing to show the snap-in attachment of the combined actuator and push-to-unlock member on the subactuator.
Figure 5:
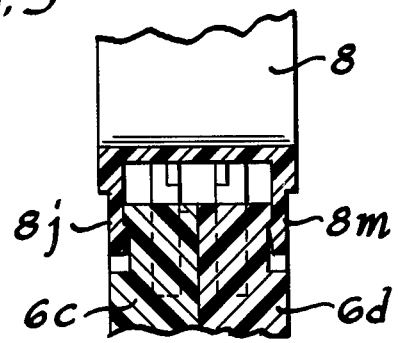
FIG. 5 is a cross-sectional view taken substantially along line 5—5 of FIG. 4 to show a pair of snap-in fingers also shown in FIG. 4.

Base 2 is provided with two compartments **2*a* and 2*b* separated by an integrally molded wall 2*c*, compartment 2*a* being shown in FIG. 1 and compartment 2*b* being similar but behind wall 2*c* as indicated by the dotted lead line. These compartments have means for supporting two sets of stationary and movable contacts consituting the two poles of the switch, respectively. For this purpose, the flat bottom of the base shown in FIGS. 1 and 4 is provided with a plurality of round holes 2*d* and 2*e* through which connectors such as rivets extend to connect internal stationary contacts to external terminals hereinafter described. There is a left stationary contact 10 connected by rivet 12 through hole 12*e* to a suitable external terminal. And there is a central stationary contact 14 connected by a rivet 16 to a suitable external terminal. Left stationary contact 10 is in the form of a flat coined element similar to a rivet head whereas central stationary contact 14 is in the form of a stationary cradle for rockably supporting a two-position movable bridging contact 18 in a conventional manner. A similar set of contacts, not shown, is provided for the other pole of the switch in the other compartment 2*b* behind wall 2*c***.

Frame 4 has a pair of inverted-T-shaped legs **4*a* and 4*b* that embrace the ends of the base and their laterally wider lower end portions have hooks 4*c* and 4*d*, respectively, that snap beneath undercut shoulders 2*f* and 2*g* at the opposite ends of the base near the lower corners thereof to secure the base and frame to one another. For switch mounting purposes, a pair of snap-in retention elements 4*e* extend upwardly from the lower end lateral portions of leg 4*a* on opposite sides of leg 4*a* and slightly spaced therefrom and extend almost to the left end of bezel portion 4f of the frame, one of these retention elements 4e being shown in FIG. 1. Similarly, another pair of such snap-in retention elements 4g extend upwardly from the lower end lateral portions of leg 4b on opposite sides of leg 4b and slightly spaced therefrom almost to the right end bezel portion 4h, one of these retention elements being shown in FIG. 1. These retention elements are integrally molded with the frame, are resilient and outwardly bowed at their upper end portions and are serrated on their outer surfaces so as to grip the rim of a hole in a mounting panel when the switch is snap-in inserted therein all the way to its bezel 4f, 4h**.

Frame 4 has integral end and side walls 4j below its bezel with the lower edges of these side walls abutting the upper edge of the base. The bottom of these walls is closed at both ends of the frame by integrally molded horizontal shelf portions 4k and 4m that abut the upper edge of the end walls of the base as shown in FIG. 1 and provide a rectangular aperture therebetween for receiving pivotal subactuator 6 and afford rocking motion thereof in this aperture. The two side walls of this frame are provided with central aligned holes for pivotally supporting the subactuator by its two oppositely extending short trunnions 6a and 6b shown in FIG. 3 and hereinafter described. These trunnions have downwardly beveled ends so that they can be snap-in mounted into these holes, the side walls of the frame being resilient and spreading enough when the subactuator is pressed therebetween to allow the trunnions to snap into their holes.

Figure 3:
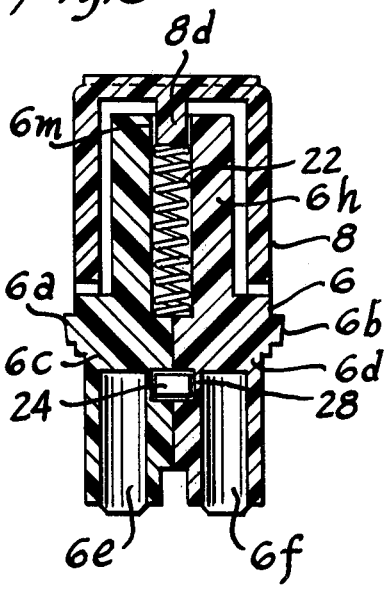
FIG. 3 is a lateral cross-sectional view of a portion of the actuator assembly taken substantially along line 3—3 of FIG. 1 to show the two halves of the subactuator and the bias spring trapped therebetween.
Figure 2:
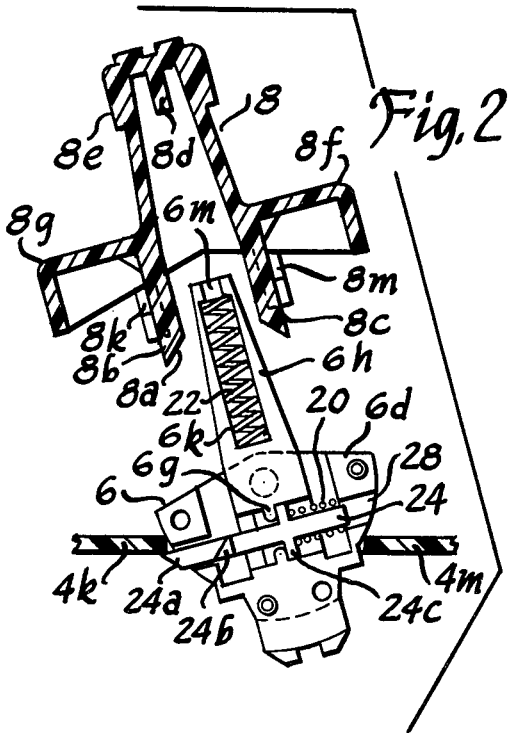
FIG. 2 is an exploded view of a portion of the switch of FIG. 1 showing the combined actuator and push-to-unlock member separated from the subactuator to prevent unauthorized operation of the switch.

As shown in FIGS. 1–3, subactuator 6 has three molded parts, an off-lock bias spring 20 and a bias spring 22 for the combined actuator and lock release member 8. These parts comprise two like subactuator halves 6c and 6d and a lock lever 24 confined and guided therebetween for limited movement as shown in FIGS. 1 and 2. These subactuator halves are provided with means for operating the movable contacts such as movable contact 18. For this purpose, each subactuator half 6c and 6d is provided with a bore 6e, 6f extending up from its lower, reduced end portion for retaining a spring-biased plunger 26, one of which is shown in FIGS. 1 and 4, and more fully shown and described in S. W. Grebner et al. U.S. Pat. No. 4,013,858, dated Mar. 22, 1977, and L. J. Josemans U.S. Pat. No. 4,168,416, dated Sept. 18, 1979, owned by the assignee of this invention. This plunger slides along and rockably actuates the on-off movable contact 18 when the subactuator is pivotally actuated. A helical spring, not shown herein, within this bore biases plunger 26 downwardly against contact 18. The movable contact of the other pole is similarly actuated by the other spring-biased plunger.

These subactuator halves are also provided therebetween with a symmetrical guiding slot 28 allowing limited reciprocal, longitudinal sliding movement of the lock lever and the latter is provided with a suitable configuration to cooperate therewith. For this purpose, molded insulating lock lever 24 is provided at one end with a tip 24a which, when extended out from the subactuator, catches below and engages the rim of the hole defined by frame plate 4k, as shown in FIG. 2. This lock lever is also provided with a pair of lateral wings 24b extending in opposite directions in alignment and having cam surfaces thereon for engagement by complementary cam surfaces 8a on a pair of lock-release projections 8b of press-to-unlock actuator 8. These lateral wings are suitably spaced from upper and lower stop lugs 24c on this lock lever as shown in FIG. 2 so that they are normally positioned within the slots along which projections 8b of the actuator are pressed when the lock is to be released as hereinafter described. Actuator 8 is also provided with two additional similar projections 8c as shown in FIG. 2 that slide into holes in the subactuator for retaining it securely on the latter and to prevent any relative motion therebetween when the switch is operated, and for making the actuator symmetrical so that it can be oriented either direction by 180 degrees when it is inserted in place. The guiding slot for this lock lever is provided with a suitable constriction 6g shown in FIG. 2 forming a stop for lugs 24c to limit the outward extension thereof under the force of its bias spring 20.

These two subactuator halves are kept in registration with one another by a plurality of suitable projections on one half fitting into complementary wells on the other half. With such interfitting engagement, the two halves are then held snugly between side walls of frame 4 with their trunnions in the holes in these side walls as hereinbefore described.

As shown in FIG. 2, this subactuator is also provided with an upstanding handle portion 6h formed by the two subactuator halves. Each subactuator half has an elongated slot 6k in its handle portion so that when the two halves are placed together, a compartment is provided therebetween for bias spring 22 as shown in FIGS. 2 and 3. This compartment has a hole 6m at the top for entry of spring-depressing finger 8d of the combined actuator and lock release member 8.

As will be apparent in FIG. 1, spring 22 bears against finger 8d and normally holds the actuator up so that projections 8b thereof are free of lock lever 24 so that the actuator will be locked "off". The actuator may be pushed down with finger 8d compressing spring 22 so that cams 8a at the lower ends of fingers 8b retract the lock lever, thus allowing operation of the switch from "off" to "on" position. When the actuator is released, spring 22 again raises the actuator so that the switch will automatically lock when turned "off".

Actuator 8 is preferably in the form of a "paddle" actuator having the upstanding handle 8e that receives therewithin handle 6h of the subactuator. Actuator 8 also has forward and rearward portions 8f and 8g that cover the subactuator and fill the hole in the frame, although other forward and rearward shapes are possible. This lock release member 8 constitutes with the subactuator a pivoted actuator assembly whereby the tip of the lock lever 24 swings past the edge of the hole in frame 4 in normal use and will catch therebelow to lock the switch "off" when the actuator is operated as instructed by the legends "on" at 30, "off" at 32 and "push-to-unlock" at 34 in FIG. 1.

This actuator serves not only as the manually engageable handle for operating the switch but also as the push-to-unlock lock releasing member and the removable "key"leaving the switch locked in its "off" position to prevent unauthorized use. For this purpose, the actuator is provided with the aforementioned cam-ended projections that release the lock when pushed in against bias spring 22. For snap-in retention, allowing limited motion for push-to-unlock action, the actuator is provided with two symmetrically arranged pairs of hooks, one pair of these hooks 8h, 8j being shown in FIG. 4, and the other pair thereof 8k, 8m being partly visible in FIG. 2. These hooks snap into stepped grooves in the opposite sides of the subactuator for retention thereon in the position shown in FIGS. 1 and 4. These grooves allow further sliding movement of the hooks in their grooves to afford push-to-unlock motion to release the off-lock.

When the switch is "off", it will normally be locked as shown in FIG. 1. To release the lock, actuator 8 is pushed down to cause retraction of lock lever 24 within the subactuator and free of the rim of the frame. When so held down, the actuator may then be swung to "on" position. When released, the bias spring will lift the actuator to allow the lock spring to extend the lock. The actuator may be snapped out and removed merely by pulling it out regardless of whether the switch is "on" or "off". When the actuator is so removed, the switch may nevertheless be turned "off" by grasping handle **6*h* of the subactuator and swinging it counter-clockwise until the angular surface at the tip of the lock lever cams against the frame causing the lock lever to retract enough to snap below the rim of the frame so that the switch locks "off". The actuator being removed, unauthorized turning of the switch "on" is prevented. The actuator must be snapped in and then pushed down to enable turning of the switch "on". Due to the detended grooves on the subactuator that retain the hooks of the actuator, the actuator will be retained on the switch but will be raised by spring 22** to allow the switch to be locked "off" when it is turned "off".

While the apparatus hereinbefore described is effectively adapted to fulfill the objects stated, it is to be understood that the invention is not intended to be confined to the particular preferred embodiment of removable push-to-unlock actuator for locking pivoted-subactuator self-enclosed electric switch disclosed, inasmuch as it is susceptible of various modifications without departing from the scope of the appended claims. For example, the off-lock illustrated could readily be changed to an on-lock either by rearranging the contacts or by reversing the lock lever.

We claim:

1. In a self-enclosed electric switch having a pivoted subactuator including an integral locking mechanism that automatically locks the switch whenever it is operated to one position requiring an additional operation to unlock the switch to allow it to be operated to its other position, a removable push-to-unlock means comprising:

a combined actuator and lock-release member, means for snap-in mounting said combined actuator and lock release member on said subactuator;

means normally biasing said combined actuator and lock-release member free of said locking mechanism thereby to render the latter effective to lock said switch in said one position;

means operable when said combined actuator and lock-release member is push-actuated against said bias means for unlocking said locking mechanism thereby to allow pivotal actuation of said subactuator along with said combined actuator and lock-release member to said other position;

said bias means being effective when said combined actuator and lock release member is released for returning the latter to said free position;

said snap-in mounting means allowing removable of said combined actuator and lock-release member to prevent unauthorized operation of said switch to said other position;

and said subactuator comprising means providing a handle when said combined actuator and lock-release member is removed for facilitating actuation thereof from said other to said one position whereupon said switch automatically locks to prevent operation thereof until said combined actuator and lock-release member is again snap-in mounted thereon and push-actuated to unlock said locking mechanism.

2. The self-enclosed electric switch claimed in claim 1, wherein said subactuator comprises:

means for trapping said biasing means so that it will be retained in operative position when said combined actuator and lock-release member is removed.

3. The self-enclosed switch claimed in claim 2, wherein:

said biasing means is a helical spring;

and said trapping means is a slot in said handle of said subactuator having an opening for entry of a portion of said combined actuator and lock-release member to compress said spring in response to said push-actuation of the latter.

4. A self-enclosed, pivoted-actuator, maintained-contact electric switch comprising:

a switch housing;

stationary and movable contacts in said housing;

a subactuator pivotally mounted on said housing for closing and opening said contacts;

locking means in said subactuator normally operative to catch on said housing to lock said subactuator in "off" position;

a push-to-unlock actuator fitting over said subactuator;

means for snap-in mounting said push-to-unlock actuator on said subactuator;

a spring trapped in said subactuator for biasing said push-to-unlock actuator into its ineffective position and being effective when pushed in to act on said locking means to retract the same and unlock said subactuator whereafter pivotal actuation of said push-to-unlock actuator carries said subactuator therewith to close said switch contacts;

said push-to-unlock actuator being removable by pulling it from said subactuator to prevent unauthorized closure of said switch contacts;

and said subactuator comprising an upstanding portion that retains said bias spring when said push-to-unlock actuator is removed and serves as a handle for actuating said subactuator from contacts-closed to contacts-open position wherein said locking means automatically catches on said housing to lock the switch.

* * * * *